United States Patent [19]

Niles et al.

[11] 4,221,446

[45] Sep. 9, 1980

[54] ELECTRICAL CONNECTOR ASSEMBLY

[75] Inventors: Paul D. Niles, Bainbridge; William P. Whallon, Jr., Unadilla; Richard W. Normann, Otego, all of N.Y.

[73] Assignee: The Bendix Corporation, Southfield, Mich.

[21] Appl. No.: 947,965

[22] Filed: Oct. 2, 1978

[51] Int. Cl.[3] ..... H01R 13/28

[52] U.S. Cl. ..... 339/49 R; 339/217 S

[58] Field of Search ..... 339/47–49, 339/59–61, 94 M, 211, 217 S, 256 R

[56] References Cited

U.S. PATENT DOCUMENTS

| | | | |
|---|---|---|---|
| 1,997,081 | 4/1935 | Reynolds | 339/211 |
| 3,097,033 | 7/1963 | Felts | 339/94 M |
| 3,123,663 | 3/1964 | Muldoon | 339/276 T |
| 3,725,844 | 4/1973 | McKeown et al. | 339/49 R |
| 3,851,296 | 11/1974 | Muchmore et al. | 339/60 M |

*Primary Examiner*—Neil Abrams

*Attorney, Agent, or Firm*—K. A. Seaman; C. D. Lacina; R. J. Eifler

[57] ABSTRACT

An electrical connector assembly (800) in which two mateable housings (200, 500) each have electrical contacts (100, 400) mounted therein. Each contact has a forward mating portion with a plurality of axially aligned wires (120, 420), each wire having an acutely angled forward end surface (122, 422). The axially aligned wires of each contact are surrounded by a shroud or sleeve (130, 430) which extends around the wires and forwardly of the end surfaces to protect them and allow the contact to be inserted into the housing from the rear through a rear-mounted grommet (300, 600). The sleeve (130) on the one contact has a larger diameter forward end than the sleeve (430) on the other mating contact to allow the sleeves to interfit together in telescoped relationship when the housings and contacts are mated. The housing (200) having the contact with the larger diameter sleeve (130) has a contact retention system which includes a forward stop (214) to captivate the contact by engaging the forward end of the sleeve. The forward end of the housing (200) includes tapered end surfaces (216) for guiding the smaller sleeve (430) into the larger sleeve (130) in proper alignment for mating of the contact wires in electrical circuit relationship.

5 Claims, 4 Drawing Figures

FIG. 1
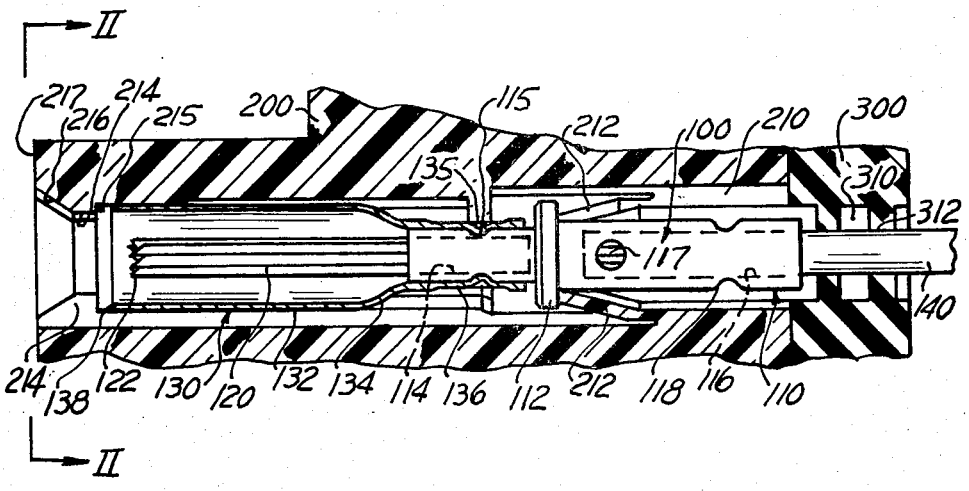
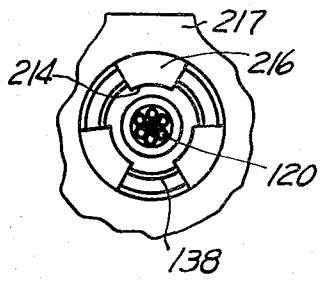
FIG. 2
PRIOR ART
FIG. 3
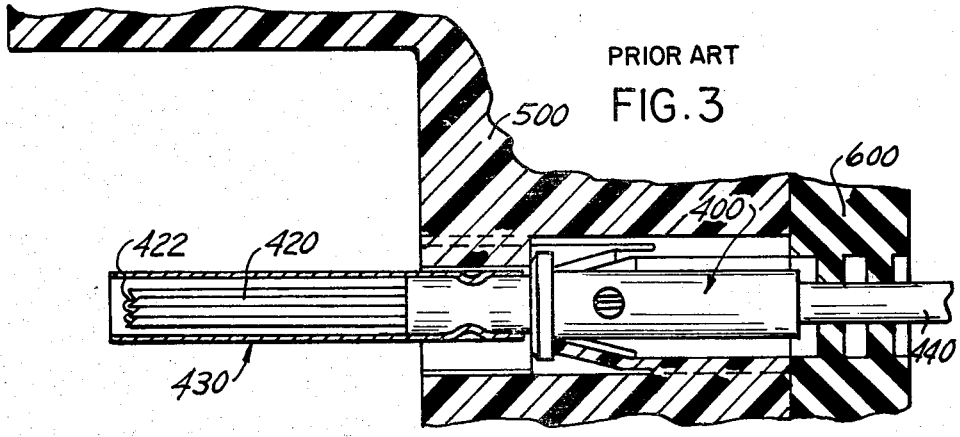

ELECTRICAL CONNECTOR ASSEMBLY

CROSS-REFERENCE TO RELATED PATENTS

The present invention is related to and an improvement upon U.S. Pat. No. 3,725,844 issued Apr. 3, 1973 to McKeown et al. for "Hermaphroditic Electrical Contact", and assigned to the assignee of the present invention. This patent is hereafter referred to as the "Brush Contact Patent" and the specification and drawings thereof are hereby specifically incorporated herein by reference.

The present invention is also related to and an improvement upon U.S. patent application Ser. No. 948,112, filed Oct. 2, 1978, concurrently with this application and entitled "Electrical Contact For an Electrical Connector". This patent is hereafter referred to as the "Shrouded Brush Contact Patent" and the specification and drawings thereof are hereby specifically incorporated herein by reference.

TECHNICAL FIELD

This invention relates to electrical connector assemblies and the mateable electrical contacts used therein. More particularly, this invention relates to electrical contacts of the type wherein a plurality of fine wires are held together and in axial alignment in a bundle and a sleeve extends around and forwardly of the fine wires for protection during contact insertion and when the assembly of two bundles is mated.

BACKGROUND AND SUMMARY OF THE INVENTION

Electrical connectors having a pair of mateable electrical contacts of the type including a plurality of fine, axially-aligned wires, each having acutely angled forward end surfaces, are well known in the prior art. Several examples of such connectors and contacts are described in the Brush Contact Patent.

Such contacts are frequently rear-insertable into a housing having a forward mating face, in accordance with preferences in some industries (e.g., aircraft manufacturing). The rear-insertable contacts allow the housing to be positioned near the point of use with the contacts each assembled to a respective conductor elsewhere, then inserted into the housing.

In some applications, it is desirable to protect the electrical circuit formed between two mating contacts from moisture. Grommets, usually made of rubber and mounted to the rear of the housing with apertures aligned with apertures in the connector housing, are advantageously used to provide this moisture protection. The grommet includes rubber webs associated with each aperture, which webs are deformable to allow a contact to pass therethrough and resilient to provide a good exposed seal between the contact and the grommet.

Insertion of the exposed (unshrouded) wires through the grommet could lead to damage to the wires or the grommet. The fine wires might be bent during insertion, reducing their effectiveness as a current carrying element. The angled end surfaces, if exposed, might pierce the rubber webs of the grommet, reducing the moisture protection properties of the grommet.

The referenced Shrouded Brush Contact Patent discloses a brush contact with a removable sleeve or shroud which has the advantage of being insertable through such a grommet, while protecting the wires and the grommet. However, the use of such a shrouded brush contact did not solve the problem of providing a moisture seal for both of the contacts of a circuit or mated line, as the use of the disclosed shroud on two mating contacts would prevent the mating of the contacts.

Accordingly, in the present invention it was determined to provide the second contact with a shroud or sleeve having a larger diameter forward portion to accomodate a contact of the type disclosed in the Shrouded Brush Contact Patent.

The provision of a larger diameter forward shroud portion interferes with a forward stop which is positioned for retaining the contacts by engaging the forward shoulder of an enlarged medium contact portion. One such arrangement is shown in U.S. Pat. No. 4,082,398 which is hereby specifically incorporated herein by reference.

The mating of a pair of contacts including interfitting shrouds also presents a possible problem that the shrouds must be accurately aligned to telescope together without adding significantly to the forces necessary to mate the connector.

The foregoing and other limitations and disadvantages of the prior art will be apparent to those skilled in the art in view of the following description and the accompanying drawings.

The present invention is an improved electrical connector assembly having two mateable brush contacts. One contact has a smaller diameter shroud and the other has a larger diameter shroud. The connectors may be assembled with the contacts mated and the shrouds telescoped together, forming an improved assembly having good electrical characteristics with physical protection and moisture resistance when the contacts are inserted through a rear grommet. Such an assembly overcomes the limitation of the prior art electrical contacts.

The electrical connector assembly of the present invention is an electrical connector assembly (800) having first and second connector housing halves (200, 500), each having mateable brush-type contacts (100, 400) mounted therein. In the one connector half (500), the contacts (400) each have a shroud (430) which is of the type described in the referenced Shrouded Brush Contact Patent. In the other connector half (200), each contact (100) has a larger shroud (130) extending around and forwardly of the angled end surfaces (122) of the fine wires for receiving the shrouded contact of the one connector in an interfitted relationship. The interfitting shrouds (130, 430) provide physical protection for the grommet and the plurality of axially aligned wires during insertion of the contact through a rear-mounted grommet and protection for the mated wires.

The foregoing and other objects and advantages of the present invention will be apparent to one skilled in the art in view of the following description and the accompanying drawings.

BRIEF DESCRIPTION OF THE DRAWINGS

FIG. 1 is a partial cross-sectional view of an electrical contact of the present invention mounted within a housing showing the contact with axially aligned wires and a shroud which surrounds the wires.

FIG. 2 is an end view of the contact and the housing of FIG. 1, looking from the line II—II in the direction of the arrows.

FIG. 3 is a cross-sectional view of the prior art electrical contact of the type described in the referenced Shrouded Brush Contact Patent.

DETAILED DESCRIPTION OF THE DRAWINGS

Figure 4:
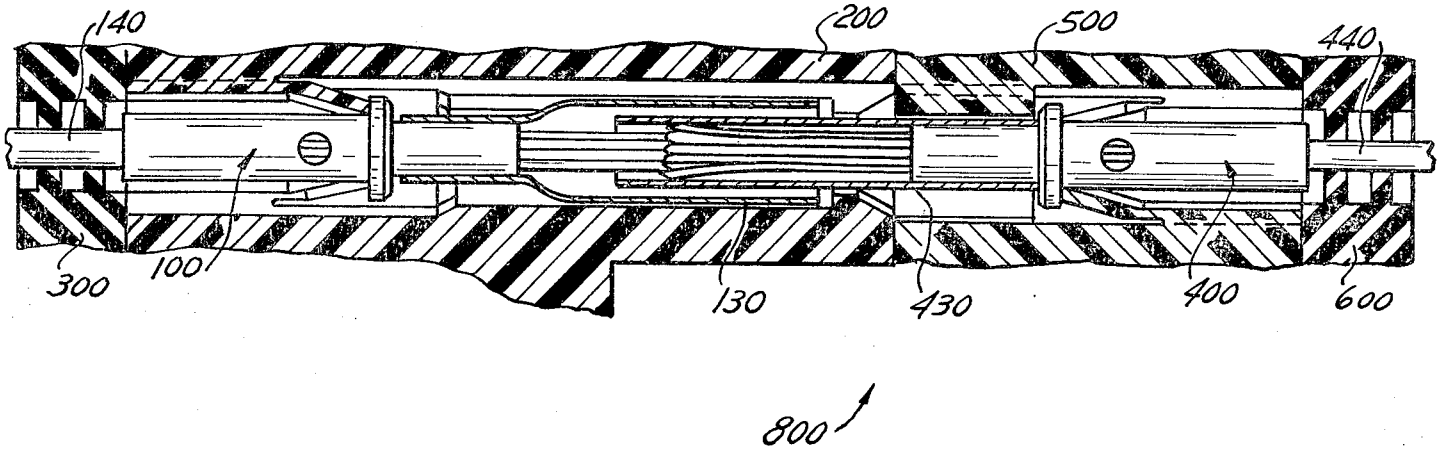
FIG. 4 is a cross-sectional view of a mated assembly of the electrical contacts of FIGS. 1 and 3.

FIG. 1 shows a partial cross-sectional view of an electrical contact 100 mounted within an electrical connector housing 200. A rear mounted rubber grommet 300 is mounted to the housing 200.

The electrical contact 100 includes a contact body 110, a plurality of axially aligned wires 120, a sleeve or shroud 130, and an electrical conductor 140.

The electrical contact body 110 is advantageously made of a copper based alloy (preferably free-machining brass having ¼%–3% lead content) and has a conventional shape including an enlarged medial portion 112, a forward internal socket 114 and a rear internal socket 116. The sockets 114, 116 are plated with gold or other suitable metal to have good electrical conductivity.

The forward socket 114 receives the axially aligned wires 120 therein. The wires 120 are retained within the socket 114 by a crimp 115. The rear socket 116 receives the electrical conductor 140 therein and has an inspection hole 117 through which the prepared forward end surfaces of the conductor 140 may be inspected after insertion into socket 116. A crimp 118 retains the electrical conductor 140 within the rear socket 116.

The axially aligned wires 120 each include a forward angled end surface 122 which is described in the referenced Brush Contact Patent.

The shroud or sleeve 130 has a forward portion 132 of a relatively large diameter, a tapering portion 134 and a rear smaller diameter portion 136. The rear portion 136 has an inside diameter which is approximately the outside diameter of the contact body 110 in its forward region, (i.e., around the forward socket 114 and forwardly of the enlarged medial portion 112). The shroud 130 is thus somewhat bell-shaped, or outwardly-flared, from the rear portion. The rear portion 136 of the shroud 130 is telescoped over the forward portion of the contact body 110 and is held in place by a crimp 135 of the shroud. The shroud 130 has a forward end 138 which extends forwardly of the acutely angled end surfaces 122 of the brush wires 120 when the sleeve is crimped in place.

The electrical connector housing 200 is preferably made from a thermoplastic polyester material such as is sold under the trademark Valox. Other thermoplastic materials having physical strengths and dielectric properties such as polyethersulfones (ICI 200P), polycarbonates (lexan), polyarylsulfones (P360 Astrel), polyamidimide (Torlon), polyamides (Nylon), and acetal (Delrin) could be used to advantage. Preferably, the housing material can be molded flash-free.

The housing 200 includes a passage 210 extending therethrough for receiving the contact 100. Associated with the passage 210 are contact retention fingers 212 in the shape of a truncated cone. These fingers or cone members are well known in the art and may be of the type shown in U.S. Pat. No. 4,082,398 to Bourdon et al., for a contact retention system.

The grommet 300 is a conventional design and made out of rubber in its preferred embodiment. The grommet has passages 310 which are aligned with the passages 210 in the housing 200, so that an electrical contact 100 may be inserted through the grommet passage 310 into the housing passage 210. Associated with each passage 310 are a plurality of rubber webs 312 which extend around the passage and are resiliently deformable to allow the larger portions (medial portion 112 and shroud 130) of the contact to pass therethrough and then to return to a smaller size to engage the electrical conductor 140 in a tight moisture-proof arrangement.

FIG. 2 shows an end view of the electrical connector housing 200 and the contact 100 mounted therein. As shown in this view, a forward stop 214 is provided the forward stop 214 being segmented (preferably three segments although two or more segments advantageously), each segment of which extend partially around the periphery of the passage. The forward stop 214 includes an outwardly tapering end portion 216 and an inner abutment face 215, shown best in FIG. 1.

This outwardly tapering end portion provides a means for aligning and guiding a mating element with the axis of the contact 100 and the shroud 130 to prevent a shroud on the second or mating contact from abutting the shroud 130 and not entering the shroud on the brush contact. Such alignment also insures that the mating will be lower in friction and thus mating force.

The segmented stop provides a method for molding the present apparatus as a single piece, to allow use of a core pin and bushing design from a prior art patent to N. C. Bourdon et al., U.S. Pat. No. 4,157,806 for "Apparatus for Making Molded Electrical Connector Insert", a patent which is hereby specifically incorporated herein by reference.

FIG. 3 illustrates a prior art contact 400 of the type disclosed in the referenced Shrouded Brush Contact Patent. The contact 400 is of the type with which the contact 100 of the present invention is adapted to be mated.

The contact 400 is mounted within a passage of a housing 500. A rubber grommet 600 is mounted to the rear of the housing 500, and an electrical conductor 440 is mounted to the contact 400 and extends through a passage in the grommet 600.

The contact 400 includes a plurality of axially aligned wires 420 having acutely angled forward end surfaces 422. A shroud 430 surrounds the wires 420 and extends forwardly of the end surfaces 422.

FIG. 4 shows a view of a mated connector assembly 800 including the contacts 100, 400 mounted within the housings 200, 500, respectively. Conductors 140, 440 extend through the respective grommets 300, 600 and into the contacts 100, 400, respectively.

Of course, while one type of contact 100 in the one housing 200 has been illustrated to mate with the other type of contact 400 in the second housing, a single housing may have contacts of both types, mounted in a single housing in a spaced relationship, so long as the corresponding mating contact in the other housing is of the other type.

The sleeves or shrouds 130, 430 disclosed in the present applications may be made from one of several materials. The best material is believed to be stainless steel which is chosen for strength, good formability, and ease of manufacture. Other materials which could be used to advantage are carbon steel or a copper based alloy. The sleeves also could be made from dielectric insulating materials. The shrouds are manufactured by cold-forming (deep-drawing) them from flat stock, although other techniques could be used.

The foregoing description of a shroud, which is manufactured as a separate piece from the contact body and subsequently assembled thereto, is presently believed to be the best manufacturing method. However, it appears possible to make the shroud integral with the contact body either by machining (metal shaving) operations, or by stamping and forming the body and shroud as a single piece from a flat piece which is rolled into the desired shape. Other manufacturing methods for making a contact body and shroud might conceivably include casting or molding or cold forming.

The foregoing description is illustrative of the preferred embodiment of the present invention. Other modifications and substitutions for the features of the present invention will be apparent to one skilled in the art. In place of the crimps disclosed to secure the shroud to the contact body, other forms of connection (e.g., press fit, welding or soldering) could be used. Further, some features may be used to advantage without the corresponding use of the other features. The foregoing description, thus, should not be considered to limit the scope of the invention, which is defined solely by the following claims.

Having thus described the invention, what is claimed is:

1. An electrical connector assembly for electrically connecting a first electrical conductor with a second electrical conductor, said electrical connector assembly comprising:

a first assembly having a front mating surface and a rear surface, said first assembly including:

a housing having a passage extending therethrough from an entranceway in the rear surface to an opening on the front mating surface and a forward member disposed adjacent the opening and partially extending into the passage;

a contact body mounted within said housing passage, said contact body having a forward end, a recess in the forward end and a rear end adapted to receive the first electrical conductor;

a plurality of axially aligned wires having acutely angled forward end surfaces, the rear end of said wires being mounted in the recess of said contact body and the forward end of said plurality of wires extending forwardly of said contact body; and a first, separately-manufactured sleeve, said first sleeve being mounted to extend forwardly of said first contact body and around and forwardly of said plurality of wires for protecting the wires from external forces, said sleeve being insertable into the passage from the entranceway on the rear surface; and a second assembly having a second front mating surface for mating with the front mating surface of the first assembly, said second assembly including:

a second housing having a second passage extending therethrough from the second front mating surface to a second rear surface;

a second contact body mounted within said second housing passage, said second contact body having a forward end, a recess in the forward end and a rear end adapted to receive the second electrical conductor;

a second plurality of axially aligned wires having acutely angled end surfaces, the rear end of said second plurality of wires being mounted within the recess of said second contact body and the other end extending forwardly of said second contact body; and a second, separately-manufactured sleeve, said second sleeve being mounted to extend forwardly from said second contact body and around and forwardly of said second plurality of wires, said second sleeve having a cross section smaller than the first sleeve and adapted to be guided into the opening by the forward member and inserted into said first sleeve upon mating of said first and second assemblies, whereby when the first and second assemblies are mated, the second sleeve fits within the first sleeve with the plurality of wires from said first and second assemblies mated in electrical circuit relationship within said interfitting sleeves and said first and second electrical conductors are thereby joined in a predetermined electrical circuit relationship.

2. An electrical connector assembly of the type described in claim 1 wherein said contact body of the first assembly includes an enlarged medial portion having a rear facing shoulder and the housing includes means for retaining the first contact body mounted to the first sleeve within the passage, said retaining means including the forward member having an abutment surface for engaging the forward end of the sleeve and a second member located medially within the passage for engaging the rear facing shoulder, said second member being resiliently radially deformable to allow a portion of the contact body and sleeve to pass therethrough.

3. An electrical connector assembly connecting a first electrical conductor in electrical circuit relationship with a second electrical conductor, said assembly comprising:

a first member having a front mating surface and a rear surface, said first member including:

a first housing having a first passage extending therethrough from an entranceway on the rear surface to an opening on the front mating surface;

a first contact, said first contact including a body having a forward end, a recess disposed in the forward end and a rear end adapted to receive the first electrical conductor and a plurality of axially aligned wires having acutely angled forward end surfaces, the rear end of said wires being mounted in the recess of said first contact body and the forward end of said plurality of wires extending forwardly of said first contact body;

a first separately manufactured sleeve, said first sleeve being mounted to extend forwardly of said first contact body and around and forwardly of said plurality of wires for protecting the wires from external forces; and means securing the first contact and sleeve within the first housing passage, said means including a member located forwardly in the passage for engaging the forward end of the sleeve and denying entry of the first sleeve and contact from the front face; and a second member having a second front mating surface for mating with the front mating surface of the first member, said second member including:

a second housing having a second passage extending therethrough from the second front mating surface to a second rear surface;

a second contact, said second contact including a body having a forward end, a recess extending rearwardly from the forward end and a rear end adapted to receive the second electrical conductor and a second plurality of axially aligned wires having acutely angled forward end surfaces, the end surfaces being mated with the first plurality of wires, the second plurality of wires having rear end portions mounted within the recess of said second contact body and forward ends extending forwardly of said second contact body;

second means securing the second contact within the second housing passage; and a second separately manufactured sleeve, said second sleeve being mounted to extend forwardly from said second contact body and around and forwardly of said second plurality of wires, with said second sleeve having a cross section smaller than the first sleeve and inserted into said first sleeve with the plurality of wires from said first and second contacts being mated in electrical circuit relationship within said interfitted sleeves and said first and second electrical conductors are joined in a predetermined electrical circuit relationship.

4. An electrical connector assembly of the type described in claim 3 wherein said assembly includes means for securing each sleeve to the respective contact body.

5. An electrical connector assembly of the type described in claim 4 wherein the means for securing the sleeves includes a plurality of crimps spaced radially about the axis of the sleeve and contact body.

* * * * *